US005614074A

United States Patent [19]

Ravindranathan

[11] Patent Number: 5,614,074

[45] Date of Patent: Mar. 25, 1997

[54] ZINC PHOSPHATE COATING FOR VARISTOR AND METHOD

[75] Inventor: Palaniappan Ravindranathan, Dundalk, Ireland

[73] Assignee: Harris Corporation, Melbourne, Fla.

[21] Appl. No.: 355,220

[22] Filed: Dec. 9, 1994

[51] Int. Cl.[6] ..... H01C 7/112

[52] U.S. Cl. ..... 205/50; 338/21; 205/123; 205/157; 205/183; 205/143; 427/101; 427/102; 427/103

[58] Field of Search ..... 205/122, 123, 205/128, 143, 157, 183, 263, 50; 148/245, 253; 427/101, 102, 103, 399; 338/13, 21

*Primary Examiner*—Kathryn Gorgos
*Assistant Examiner*—Brendan Mee
*Attorney, Agent, or Firm*—Rogers & Killeen.

[57] ABSTRACT

A method of providing a semiconductor device with an inorganic electrically insulative layer, the device having exposed semiconductor surfaces and electrically conductive metal end terminations, in which the device is reacted with phosphoric acid to form a phosphate on the exposed surfaces of the semiconductor but not on the metal end terminations, and in which the device is thereafter barrel plated in a conventional electrical barrel plating process and the plating is provided only on the end terminations because the phosphate is not electrically conductive.

25 Claims, 1 Drawing Sheet

ZINC PHOSPHATE COATING FOR VARISTOR AND METHOD

BACKGROUND OF THE INVENTION

The present invention relates to nonlinear resistive devices, such as varistors, and more particularly to methods of making such devices using barrel plating techniques in which only the electrically contactable end terminals of the device are plated.

Nonlinear resistive devices are known in the art, and are described, for example, in U.S. Pat. No. 5,115,221 issued to Cowman on May 19, 1992, that is incorporated by reference.

With reference to FIG. 1, a typical device 10 may include plural layers 12 of semiconductor material with electrically conductive electrodes 14 between adjacent layers. A portion of each electrode 14 is exposed in a terminal region 16 so that electrical contact may be made therewith. The electrodes 14 may be exposed at one or both of opposing terminal regions, and typically the electrodes are exposed at alternating terminal regions 16 as illustrated. The exposed portions of the electrodes 14 are contacted by electrically conductive end terminals 18 that cover the terminal regions 16.

The apparently simple structure of such devices belies their manufacturing complexity. For example, the attachment of the end terminals 18 has proved to be a problem in search of a solution. As is known, the terminal regions may be plated with nickel and tin-lead metals to increase solderability and decrease solder leaching. One method of affixing the end terminals 18 is to use a conventional barrel plating method in which the entire device is immersed in a plating solution. However, the stacked layers are semiconductor material, such as zinc oxide, that may be conductive during the plating process so that the plating adheres to the entire surface of the device. Thus, in order to provide separate end terminals as shown in FIG. 1, a portion of the plating must be removed after immersion, or covered before immersion with a temporary plating resist comprised of an organic substance insoluble to the plating solution. However, the removal of the plating or organic plating resist is an extra step in the manufacturing process, and may involve the use of toxic materials that further complicate the manufacturing process.

It has also been suggested that the metal forming the end terminals 18 be flame sprayed onto the device, with the other portions of the surface of the device being masked. Flame spraying is not suitable for many manufacturing processes because it is slow and includes the creation of a special mask, with the additional steps attendant therewith. See, for example, U.S. Pat. No. 4,316,171 issued to Miyabayashi, et al. on Feb. 16, 1982.

Accordingly, it is an object of the present invention to provide a novel method and device that obviates the problems of the prior art.

It is another object of the present invention to provide a novel method and device in which an electrically insulating, inorganic layer is formed on portions of the device before the device is barrel plated.

It is still another object of the present invention to provide a novel method and device in which a phosphoric acid is reacted with the exposed surface of stacked zinc oxide semiconductor layers to form a zinc phosphate coating.

It is yet another object of the present invention to provide a novel method and device in which a zinc phosphate coating protects portions of the device that are not to be plated when the end terminals are formed.

It is a further object of the present invention to provide a novel method of providing a semiconductor device with an inorganic electrically insulative layer in which a device with exposed semiconductor surfaces and metal end terminations is submerged in phosphoric acid to form a phosphate on the exposed surfaces of the semiconductor, and in which the device is thereafter barrel plated and the plating is provided only on the end terminations because the phosphate is not electrically conductive.

It is yet a further object of the present invention to provide a novel method and nonlinear resistive device having a body of layers of semiconductor material with an electrode between adjacent layers, in which the body of the nonlinear resistive device is coated with an inorganic layer that is electrically insulating, except at a terminal region of the body where an electrode is exposed for connection to an end terminal, and in which the coated body is plated with an electrically conductive metal to form the end terminal in a process in which the body becomes electrically conductive and in which the electrically conductive metal does not plate the coated portions of the body because the inorganic layer is not electrically conductive.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
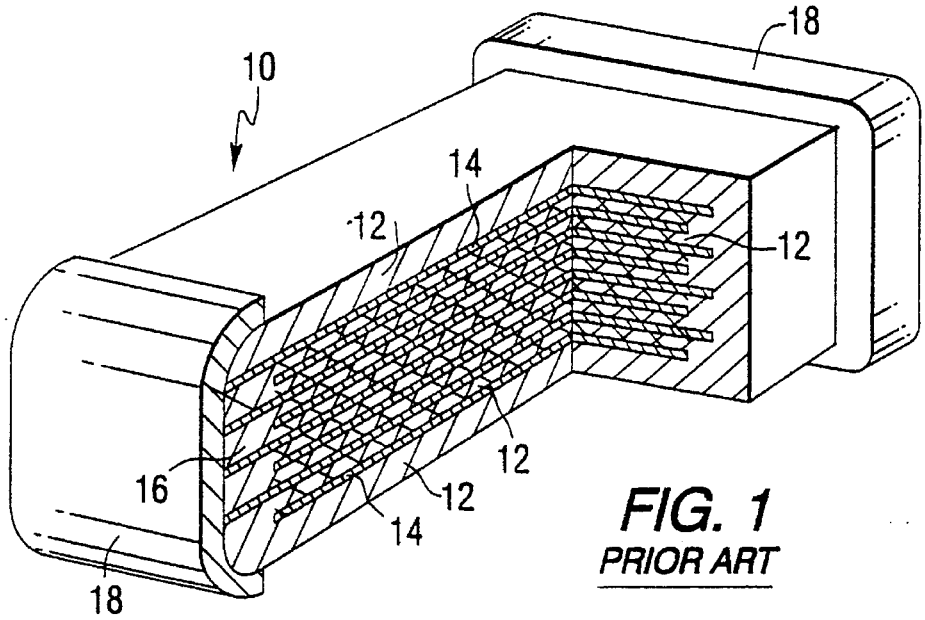
FIG. 1 PRIOR ART
FIG. 1 is a pictorial depiction of a varistor typical of the prior art.
Figure 2:
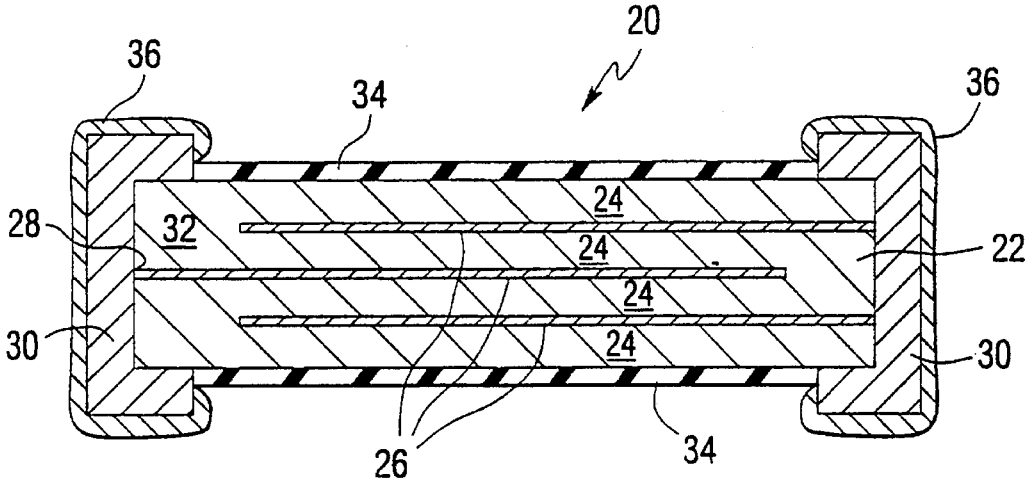
FIG. 2 is vertical cross section of an embodiment of the device of the present invention.

With reference now to FIG. 2, an embodiment of a nonlinear resistive element 20 may include a body 22 having stacked zinc oxide semiconductor layers 24 with generally planar electrodes 26 between adjacent pairs of layers 24. Each electrode 26 may have a contactable portion 28 that is exposed for electrical connection to electrically conductive metal (preferably silver, silver-platinum, or silver-palladium) end terminations 30 that cover terminal regions 32 of the body 22 and contact the electrodes 26. The portions of body 22 not covered with the end terminations 30 are coated with an electrically insulative zinc phosphate layer 34. The end terminations 30 may be plated with layers 36 of electrically conductive metal that form electrically contactable end portions for the resistive element 20. By way of example, in one embodiment the zinc oxide layers 24 may have the following composition in mole percent: 94–98% zinc oxide and 2–6% of one or more of the following additives; bismuth oxide, cobalt oxide, manganese oxide, nickel oxide, antimony oxide, boric oxide, chromium oxide, silicon oxide, aluminum nitrate, and other equivalents.

The body 22 and end terminations 30 may be provided conventionally. The zinc phosphate layer 34 may be formed by reacting phosphoric acid with the zinc oxide semiconductor layers exposed at the exterior of the body 22. The reaction may take place for 25–35 minutes at 70° to 80° C. By way of example, one part orthophosphoric acid (85 wt %) may be added to fifty parts deionized water. The solution may be heated to 75° C. and stirred. The body 22 with end terminations 30 affixed may be washed with acetone and dried at 100° C. for ten minutes. The washed device may be submerged in the phosphoric acid solution at 75° C. for thirty minutes to provide the layer 34. After the layer 34 is applied, the body may be cleaned with hot, deionized water and dried at about 100° C. for about fifteen minutes. The layer 34 does not adhere to the end terminations 30 because the silver or silver-platinum in the end terminations 30 is not affected by the phosphoric acid. The phosphoric acid solution may also be applied by spraying, instead of submerging, the washed device.

After the zinc phosphate layer 34 has been applied, the device may be barrel plated with an electrically conductive metal, such as nickel and tin-lead, to provide the layers 36. A conventional barrel plating process may be used, although the pH of the plating solution is desirably kept between about 4.0 and 6.0. In the barrel plating process the device is made electrically conductive and the plating material adheres to the electrically charged portions of the device. The metal plating of layers 36 does not plate the zinc phosphate layer 34 during the barrel plating because the zinc phosphate is not electrically conductive.

The zinc phosphate layer 34 is electrically insulating and may be retained in the final product to provide additional protection. The layer 34 does not effect the I–V characteristics of the device.

In an alternative embodiment, the phosphate layer may be an inorganic oxide layer formed by the reaction of phosphoric acid with the metal oxide semiconductor in the device. For example, instead of zinc oxide, the semiconductor may be iron oxide, a ferrite, etc.

Figure 3:
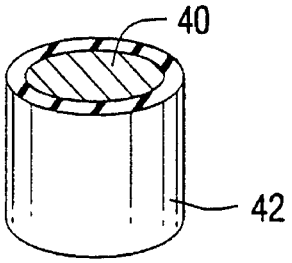
FIG. 3 is a pictorial depiction of a high energy disc varistor with an insulating layer of the present invention thereon.
Figure 4:
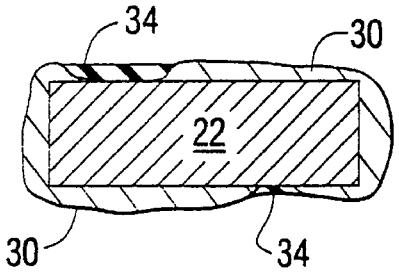
FIG. 4 is a pictorial depiction of a surface mount device with an insulating layer of the present invention.

In another alternative embodiment, the method described above may be used in the manufacture of other types of electronic devices. For example, a high energy disc varistor has a glass or polymer insulating layer on its sides. With reference to FIG. 3, instead of glass or polymer, the disc varistor 40 may have an insulating layer 42 of phosphate formed in the manner discussed above. The present invention is applicable to other varistor products such as a surface mount device depicted in FIG. 4, radial parts, arrays, connector pins, discoidal construction, etc.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of providing a semiconductor device with an inorganic electrically insulative layer, the semiconductor device having an exposed semiconductor surface and electrically conductive metal end terminations, the method comprising the steps of:

(a) exposing the semiconductor device to a phosphoric acid solution to form a phosphate coating on the exposed semiconductor surfaces, and not on the end terminations; and (b) coating the semiconductor device with an electrically conductive metal in a process in which the device is electrically charged and submerged in a plating solution, the metal being formed on the end terminations and not on the phosphate coating because the phosphate coating is not electrically conductive.

2. The method of claim 1 wherein the exposed semiconductor surfaces comprise one of zinc oxide and iron oxide.

3. The method of claim 1 wherein the phosphoric acid solution comprises orthophosphoric acid and deionized water.

4. The method of claim 1 wherein the exposing step comprises the step of submerging the device in the phosphoric acid solution.

5. The method of claim 4 wherein the step of submerging the device comprises the step of submerging the device in a orthophosphoric acid solution for 25 to 35 minutes at 70° to 80° C.

6. The method of claim 1 wherein the exposing step comprises the step of spraying the device with the phosphoric acid solution.

7. The method of claim 1 wherein the device is a varistor.

8. A nonlinear resistive element made by the process of claim 1.

9. A method of providing an electrically insulative coating for a varistor, the method comprising the steps of:

(a) providing an uncoated varistor having plural zinc oxide layers with electrodes therebetween, the electrodes contacting at least one of two exterior electrically conductive metal end terminations that are separated by an exposed surface of the zinc oxide layers;

(b) submerging the uncoated varistor in a phosphoric acid solution for 25 to 35 minutes at 70° C. to 80° C. to form an electrically insulative zinc phosphate coating on the exposed surface of the zinc oxide layers, the end terminations not being coated with the zinc phosphate coating; and (c) subjecting the coated varistor to a barrel plating process in which the varistor is electrically charged and an electrically conductive plating material adheres to the charged portions of the varistor, the end terminations being plated and the zinc phosphate coating not being plated.

10. A method of making a nonlinear resistive device comprising the steps of:

(a) providing a body for the nonlinear resistive device, the exterior of the body being a zinc oxide semiconductor except at an end termination region; and (b) reacting a phosphoric acid with the body to form an electrically insulative zinc phosphate coating on the exposed zinc oxide semiconductor, the end termination region not being coated with the zinc phosphate.

11. The method of claim 10 further comprising the step of coating the body to cover the end termination region with an electrically conductive metal, wherein the electrically conductive metal does not form on the zinc phosphate coated portions of the body.

12. The method of claim 11 wherein the electrically conductive metal comprises nickel.

13. The method of claim 11 wherein the step of coating the body comprises the step of barrel plating the body.

14. The method of claim 11 wherein the step of coating the body comprises the step of coating nickel over a layer on the end termination region, the layer being a metal selected from the group consisting of silver, silver-platinum, and silver-palladium.

15. The method of claim 10 wherein the body comprises in mole percent, 94–98% zinc oxide and 2–6% of one or more of the additives selected from the group of additives consisting of bismuth oxide, cobalt oxide, manganese oxide, nickel oxide, antimony oxide, boric oxide, chromium oxide, silicon oxide, and aluminum nitrate.

16. The method of claim 10 wherein the step of reacting phosphoric acid comprises the step of submerging the body in the phosphoric acid.

17. The method of claim 16 wherein the step of submerging the body comprises the step of submerging the body in a orthophosphoric acid solution for 25 to 35 minutes at 70° to 80° C.

18. The method of claim 10 wherein the step of reacting phosphoric acid comprises the step of spraying the body with the phosphoric acid.

19. The method of claim 10 wherein the body is a varistor.

20. A method of providing a nonlinear resistive element with an electrically insulative layer, the nonlinear resistive element having an exposed semiconductor surface and electrically conductive metal end terminations, the method comprising the steps of exposing the nonlinear resistive element to a phosphoric acid solution, and forming a phosphate coating on the exposed semiconductor surface and not on the end terminations.

21. The method of claim 20 further comprising the step of barrel plating the semiconductor device with a nickel plating in a process in which the device is electrically charged and submerged in a nickel plating solution, the nickel plating being formed on the end terminations and not on the phosphate coating because the phosphate coating is not electrically conductive.

22. The method of claim 21 further comprising the step of providing zinc oxide as the exposed semiconductor surface.

23. The method of claim 21 further comprising the step of providing end terminations that comprise a metal selected from the group consisting of silver, silver-platinum, and silver-palladium.

24. The method of claim 11 wherein the electrically conductive metal comprises nickel and tin-lead.

25. The method of claim 11 wherein the step of coating the body comprises the step of coating nickel and tin-lead over a layer on the end of the termination region, the layer being a metal selected from the group consisting of silver, silver-platinum, and silver-palladium.

* * * * *